US006915094B2

(12) United States Patent
Tsuruya et al.

(10) Patent No.: US 6,915,094 B2
(45) Date of Patent: Jul. 5, 2005

(54) COMPOSITION FOR ACCESSING A MEMORY IN IMAGE FORMATION APPARATUS AND METHOD FOR ACCESSING A MEMORY IN IMAGE FORMATION APPARATUS

(75) Inventors: Satoshi Tsuruya, Shizuoka (JP); Shinichi Tsukida, Saitama (JP); Katsuhiro Sakaizawa, Shizuoka (JP); Takehiko Suzuki, Shizuoka (JP); Seiichi Shinohara, Shizuoka (JP); Masahiro Shibata, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/337,885

(22) Filed: Jan. 8, 2003

(65) Prior Publication Data

US 2003/0133719 A1 Jul. 17, 2003

(30) Foreign Application Priority Data

Jan. 16, 2002 (JP) ..... 2002-007985
Feb. 28, 2002 (JP) ..... 2002-054661

(51) Int. Cl.[7] ..... G03G 15/01; G03G 15/00
(52) U.S. Cl. ..... 399/227; 399/12; 399/13
(58) Field of Search ..... 399/12, 13, 24, 399/25, 27, 28, 111, 112, 119, 223, 226, 227, 258, 262, 263

(56) References Cited

U.S. PATENT DOCUMENTS 4,697,915 A * 10/1987 Hayashi et al. ..... 399/227
4,937,624 A 6/1990 Kohtani et al. ..... 355/245
4,937,626 A 6/1990 Kohtani et al. ..... 355/245
4,961,088 A * 10/1990 Gilliland et al. ..... 399/25
RE35,751 E * 3/1998 Midgley ..... 399/25
5,887,217 A * 3/1999 Mitekura et al. ..... 399/13
6,091,913 A 7/2000 Suzuki et al. ..... 399/49
6,122,470 A * 9/2000 Kimura ..... 399/227
6,253,035 B1 * 6/2001 Kawana et al. ..... 399/24
6,324,352 B1 * 11/2001 Suzuki ..... 399/13
6,549,732 B2 * 4/2003 Yoshizaki et al. ..... 399/12
2002/0051143 A1 5/2002 Tsuruya ..... 358/1.8

* cited by examiner

*Primary Examiner*—Sandra L. Brase
(74) *Attorney, Agent, or Firm*—Fitzpatrick, Cella, Harper & Scinto

(57) ABSTRACT

A color printer has multiple developing-agent-containing cartridges each having storage units, and a cartridge holding unit for rotatably holding the developing-agent-containing cartridges. With one of the multiple developing-agent-containing cartridges positioned at an image formation position, a latent image on an image carrying member is developed by the developing agent contained in the developing-agent-containing cartridge. An access position where the storage units of the developing-agent-containing cartridges are accessed is a position other than the image formation position. This provides an image formation device and a control method thereof whereby storage units provided to developing-agent-containing cartridges can be accessed in a precise manner.

8 Claims, 13 Drawing Sheets

COMPOSITION FOR ACCESSING A MEMORY IN IMAGE FORMATION APPARATUS AND METHOD FOR ACCESSING A MEMORY IN IMAGE FORMATION APPARATUS

BACKGROUND OF THE INVENTION

1. Field of the Invention

The present invention relates to an image formation apparatus such as a copier or laser printer, for example, which employs electrophotography, and particularly relates to an image formation apparatus and a control method thereof, having multiple cartridges each of which comprises at least one component of an image formation unit, and is detachably configured, in the main unit of the color image formation apparatus.

2. Description of the Related Art

Conventional color image formation apparatuses which can detachably mount multiple developing agent storage cartridges have been known. FIG. 9 illustrates a rotary-type image formation apparatus which has been conventionally known, and which detachably and rotatably holds multiple developing agent storage cartridges. With this method, image formation is performed by a cartridge holding unit disposing one of multiple developer storage cartridges at a image formation position.

With the rotary-type color printer shown in FIG. 9, a photosensitive drum 10, which is a image carrying member, is driven in the direction of the arrow shown in the drawing by a driving means not shown, and is uniformly charged by a first charging device 20. Next, a laser beam L generated according to yellow image patterns is cast on the photosensitive drum 10 by an exposure device 30, and a latent image is formed on the photosensitive drum 10. In the event that the photosensitive drum 10 moves further in the direction of the arrow, of the process cartridges 40*a*, 40*b*, 40*c*, and 40*d*, which are held by a rotational supporting member 110, the cartridge 40*a* containing yellow toner, for example, is rotated so as to face the photosensitive drum 10. The electrostatic latent image on the photosensitive drum 10 is then manifested by yellow toner in the selected process cartridge 40*a*. An intermediate transfer belt 50 rotates at generally the same speed as the photosensitive drum 10 in the direction of the arrow, and performs primary transfer of a toner image, which has been formed and is carried by the photosensitive drum 10, onto the outer circumference of the intermediate transfer belt 50, by the first transferring bias voltage applied to a first transferring roller 80*a*. The above processing is performed for multiple colors, i.e., yellow, magenta, cyan, and black, thereby forming a toner image in multiple colors on the intermediate transfer belt 50. Next, a recording medium is supplied by a pickup roller 130 from a recording medium cassette 120 at a predetermined timing. At the same time, a second transferring bias voltage is applied to a second transferring roller 80*b*, and the toner image is transferred from the intermediate transfer belt 50 to the transferring member.

Moreover, the transferring member is transported to a fixing unit 60 by a transporting belt 140, and is fixed by melting, thereby obtaining a color image. Also, the residual toner on the intermediate transfer belt 50 is charged by an intermediate transferring cleaning roller 150, and is reverse-transferred onto the photosensitive drum at the next time for primary transfer. On the other hand, the residual toner following transferring on the photosensitive drum 1 is cleaned up by a cleaning device 70.

Here, each of the process cartridges 40*a*, 40*b*, 40*c*, and 40*d*, integrally comprise toner, a developing roller, developing plate, and so forth, and are detachably mounted with regard to the printer body. Also, NV (Non-Volatile) RAM 41*a*, 41*b*, 41*c*, and 41*d*, are provided on the sides of the cartridges as non-volatile storage units for storing information regarding the process cartridge or the like. Also, a reading/writing means 42 is provided at a position so as to face or contact one of the NVRAM 41*a*, 41*b*, 41*c*, or 41*d*, which faces the photosensitive drum 10 at the position P0. Reading/writing of information stored in the NVRAM is performed at a timing such as at the timing of turning on the power supply, the timing after printing of a predetermined number of sheets, or the like, and processing wherein image formation conditions are changed, or notice of remaining toner or end of life span and so forth is given to users, is performed corresponding to the information. However, in the event that NVRAM is accessed at such the image formation position (developing position), it is likely that accurate data communication can not be performed due to scattering of toner or influence of the developing voltage.

That is to say, with the rotary-type image formation apparatus, in a case wherein the storage unit such as non-volatile memory or the like is provided at the developing agent storage cartridge so as to manage the life span of the cartridges or the like, it is likely that accurate communication can not be performed due to influence of scattered developer or electric noise due to the developing voltage in the event of accessing the storage unit at the image formation position (developing position).

SUMMARY OF THE INVENTION

It is an object of the present invention to improve a color image formation apparatus having multiple cartridges which are each detachably configured, and which each comprise at least one component of an image formation unit.

It is another object of the present invention to provide an image formation apparatus and a control method thereof whereby a storage unit provided to a cartridge comprising at least one component of an image formation unit can be accessed in a precise manner.

It is a further object of the present invention to provide an image formation apparatus and a control method thereof whereby, in an image formation apparatus having detachable cartridges comprising at least one component of multiple image formation units, developing-agent-containing cartridges which have reached the end of the life span thereof can made to be immediately replaceable.

An image formation apparatus according to the present invention comprises: a rotatable holding member having a plurality of mounting units for mounting, to predetermined mounting positions, a plurality of cartridges comprising at least one component of image formation units; reading means for reading information from storage means storing the information regarding the cartridge held by the holding member; and control means for making judgment of acceptance or rejection with regard to the cartridge based upon the information read out by the reading means, with the storage means being mounted on the cartridge.

Another image formation apparatus according to the present invention comprises: an N number of developing-agent-containing cartridges each of which have storage means; and cartridge holding means for rotatably holding the developing-agent-containing cartridges; wherein, in a state that one of the plurality of cartridges is disposed at the image formation position by the cartridge holding means, a latent image on an image carrying member is manifested by the developing agent contained in the cartridge; and wherein an accessing position at which the storage means of the cartridge is accessed is a position other than the image formation position.

Another image formation apparatus according to the present invention comprises: a holding member which can hold a plurality of cartridges, each of which comprise a developing device containing a developing agent, and a storage unit for storing information regarding the developing device; wherein the plural cartridges are detachable with regard to the holding member; a control unit for rotationally driving the holding member with the plurality of cartridges mounted thereon, controlling the plurality of cartridges mounted to the holding member so as to consecutively shift to the image formation position; and an accessing unit for accessing the storage unit of the cartridge at a different position from the image formation position.

A control method for an image formation apparatus according to the present invention comprises: a step for detecting that cartridges comprising at least one component of image formation units are mounted to mounting positions of a rotatable holding member; a reading step for reading information with regard to the cartridge from storage means provided to the cartridge for storing the information; and a judgment step for making judgment of acceptance or rejection with regard to the cartridge based upon the information read out by the reading step.

Another control method for an image formation apparatus according to the present invention which comprises an N number of developing-agent-containing cartridges each of which have storage means and cartridge holding means for rotatably holding the developing-agent-containing cartridge, is a control method wherein a latent image on an image carrying member is manifested by a developing agent contained in the developing-agent-containing cartridge in the state that one of the plurality of developing-agent-containing cartridges is disposed at the image formation position by the cartridge holding means, and wherein the storage means is accessed at a position other than the image formation position.

Further objects, features and advantages of the present invention will become apparent from the following description of the preferred embodiments with reference to the attached drawings.

DESCRIPTION OF THE PREFERRED EMBODIMENTS

Figure 1:
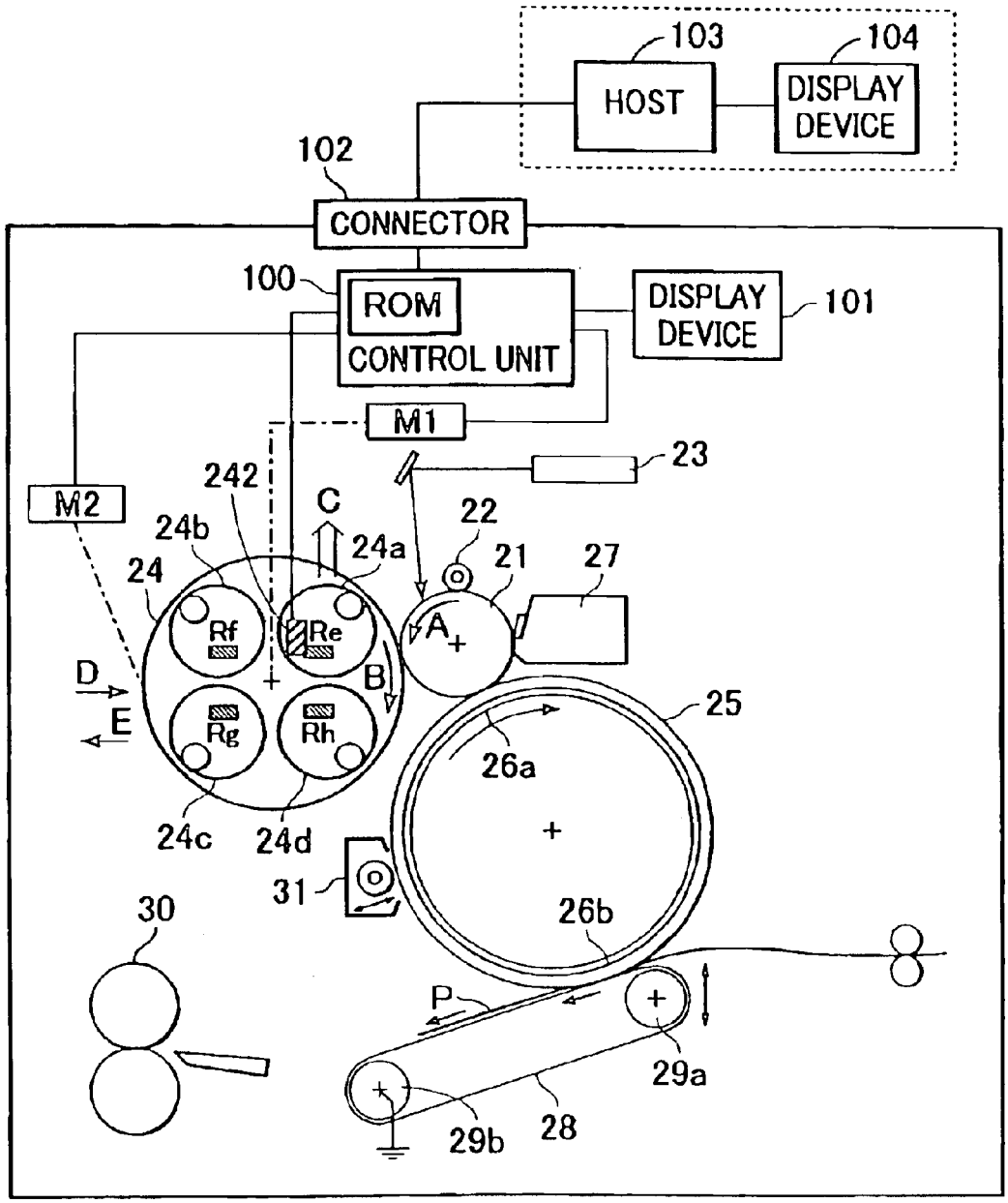
FIG. 1 is a diagram which illustrates the configuration of the first embodiment of the image formation apparatus according to the present invention.

The first embodiment of the present embodiment will be described with reference to FIGS. 1, 2, and 3. FIG. 1 is a configuration diagram which describes the image formation apparatus according to the present invention. The image formation apparatus is electrically connected to a host 103 such as a personal computer, workstation, or the like, by a connector 102, and receives image data via a video interface corresponding to printing request signals from the host 103. The image formation apparatus is a rotary-type color printer wherein toner images, each of which have different color, are consecutively formed based upon the image data divided into four colors, i.e., yellow Y, cyan C, magenta M, and black Bk, based upon the image data; these toner images are overlapped onto an intermediate transferring member, and are transferred onto a recording medium such as a paper sheet or the like, all at once, thereby obtaining a full color image.

In FIG. 1, reference numeral 21 is a photoelectroconductive organic photosensitive drum as an electrostatic image carrying member, which is driven in a rotational manner in the direction of the arrow A. The surface of the photosensitive drum 21 is uniformly charged at a predetermined potential for dark areas by applying a bias voltage to a core of an charging roller 22 as a contact-type charging means. Next, scanning exposure is performed by a laser beam under the on/off control of an exposure means 23 corresponding to the image data of the first color (Y), and the first electrostatic latent image is formed as the potential for light areas. The electrostatic latent image thus formed is developed so as to be manifested by a developer for each color, which is a developing means mounted within a rotary 24 that is a holding member rotatably mounted. The rotary has a configuration which integrally comprises a first developing device 24*a* containing Y toner as the first color, a second developing device 24*b* containing M toner as the second color, a third developing device 24*c* containing C toner as the third color, and a fourth developing device 24*d* containing Bk toner as the fourth color, and is moved in a rotational manner to a photosensitive drum facing position (in the direction of the arrow B) at the point that each color image is formed, by a motor M1 which is a driving unit. A sleeve which holds toner limited to a predetermined film thickness is driven in a rotational manner, and developing is performed by applying a predetermined bias to the core of the sleeve. Also, each developing means 24*a*, 24*b*, 24*c*, and 24*d*, of Y, M, C, and Bk, can be separately replaced corresponding to the consumption degree thereof as one process cartridge (developing cartridge).

First of all, the above-described first electrostatic latent image is developed by the first developing cartridge 24*a* containing Y toner as the first color toner, so as to be manifested. While a non-contact method may be used as well as a contact method as a developing method, the contact developing method by non-magnetic single-composition toner, which is a combination of image exposure and inverse developing, is employed with the present embodiment. The manifested first color toner image is electrostatically transferred (primary transfer) onto the surface of an intermediate transferring member 25, which is made up of an electroconductive elastic layer and a surface layer on a cylinder having a separable nature, at a first transferring portion 26*a*, which is a nipping portion, with an intermediate transferring member 25 as the second image carrying member. The intermediate transferring member 25 has a circumferential length longer than that of the maximum-sized transferring member which may be transported, and is driven in a rotational manner in the reverse direction of the rotational direction of the photosensitive drum 21 at generally the same circumferential speed as that of the photosensitive drum, while being pressed into contact against the above-described photosensitive drum 21 under a predetermined pressure. The toner image, which is formed on the photosensitive drum 21 as described above, is then electrostatically transferred (primary transfer) onto the surface of the intermediate transferring member 25 by applying a voltage reverse to the charge polarity of the toner (primary transfer bias voltage), to the cylinder unit of the intermediate transferring member 25.

Note that the residual toner on the surface of the photosensitive drum 21 at the point that the first transferring has ended is removed by a cleaning device 27, so as to prepare for the next latent image formation. Details of cleaning of residual toner will be described later.

Repeating the same processing consecutively, each of the toner images, i.e., the second color toner image developed with M toner, the third color toner image developed with C toner, and the fourth color toner image developed with Bk toner, are sequentially transferred in a layer-building manner onto the surface of the intermediate transferring member 25 at each processing, thereby forming a color toner image. Subsequently, a transfer belt 28 which initially had a space between itself and the surface of the intermediate member 25 is pressed into contact against the surface of the intermediate member 25 under a predetermined pressure, and is driven in a rotational manner. The transfer belt 28 is supported by a transferring roller 29*a* and a tension roller 29*b*, the color toner image layered on the surface of the intermediate member 25 is transferred all at once (secondary transfer) onto the surface of a recording medium P transported at a predetermined timing to the second transferring unit 26*b*, by applying a bias voltage reverse to the charge polarity of the toner (secondary transfer bias voltage) to the above-described transferring roller 29*a*, and the recording medium P is transported to a fixing unit 30 so as to fix for a permanent image and is discharged externally, thereby obtaining a desired color printing image.

Also, the residual toner on the intermediate transferring member 25 at the point that the second transferring has ended is removed by a intermediate transferring member cleaning device 31 which contacts the surface of the intermediate transferring member 25 at a predetermined timing.

The rotary 24 for detachably supporting the developing cartridges has a configuration which moves in the directions of the arrows F and G shown in FIG. 1, and in the event that image formation is not performed, the rotary 24 stops in a state shifted in the direction of the arrow E. In this case, each developing cartridge stops at the mounting/detaching position, and is configured such that the developing roller does not come into contact with the drum 21.

Now, it should be noted that the mounting position and the detaching position of the cartridges is one and the same, so while the phrase "mounting/detaching position" is most accurate, for sake of simplicity in the description this will be simply referred to as "mounting position" or "detaching position", according to whether the cartridge is being mounted or detached.

Upon performing the image formation operations as described above, first of all, the image formation operation begins according to the instructions from the host 103. The rotary 24 rotates prior to image formation, and upon the developing roller of the developing cartridge reaching the image formation position (developing position) at which the developing agent roller contacts the drum, the rotary 24 moves in the direction of the arrow D so as to perform developing operations, thereby performing image formation. In the event that the flow proceeds to the developing with the next developing cartridge, the rotary is shifted in the direction of the arrow E, and is driven in a rotational manner, and upon the next developing cartridge reaching the developing position, the rotary is shifted in the direction of the arrow D again, and developing operations are performed. While the shifts in the directions of the arrows D and E will be described later, the shifts are performed by driving a motor M2 by transmitting instruction signals from a control unit 100 to the motor M2.

Figure 12:
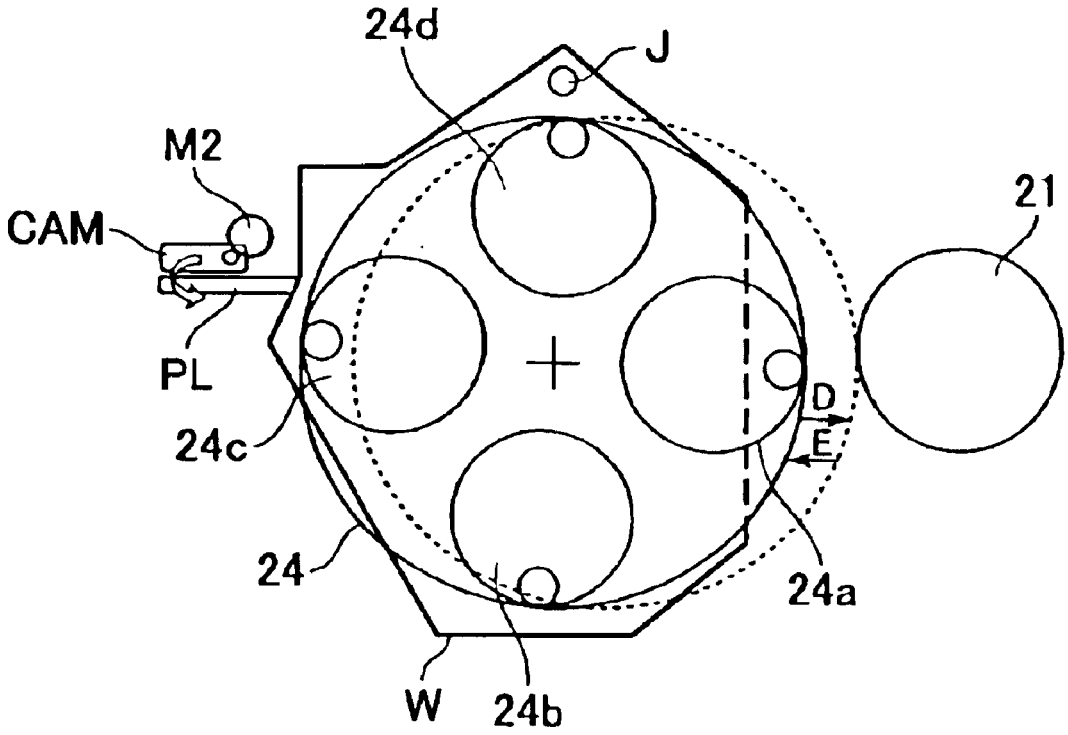
FIG. 12 is a diagram which illustrates the configuration of the moving cartridge according to the present invention.

As shown in FIG. 12, the configuration wherein the rotary 24 is shifted in the directions of the arrows D and E, is such that the shaft J provided at the top of the rotary serves as a fulcrum so that the rotary is mounted movably in the directions of the arrows D and E. The shift is performed by operations wherein the instruction signals are transmitted from the control unit 100 to the motor M2, and the motor M2 which is a driving unit rotates a connecting cam (CAM), which is provided for pressing a plate PL provided at a frame W of the rotary, so as to press the plate L, thereby shifting the rotary 24 in the direction D or E. Note that reference characters 24*a*, 24*b*, 24*c*, and 24*d*, denote developing cartridges, and 21 denotes a photosensitive drum.

Figure 2:
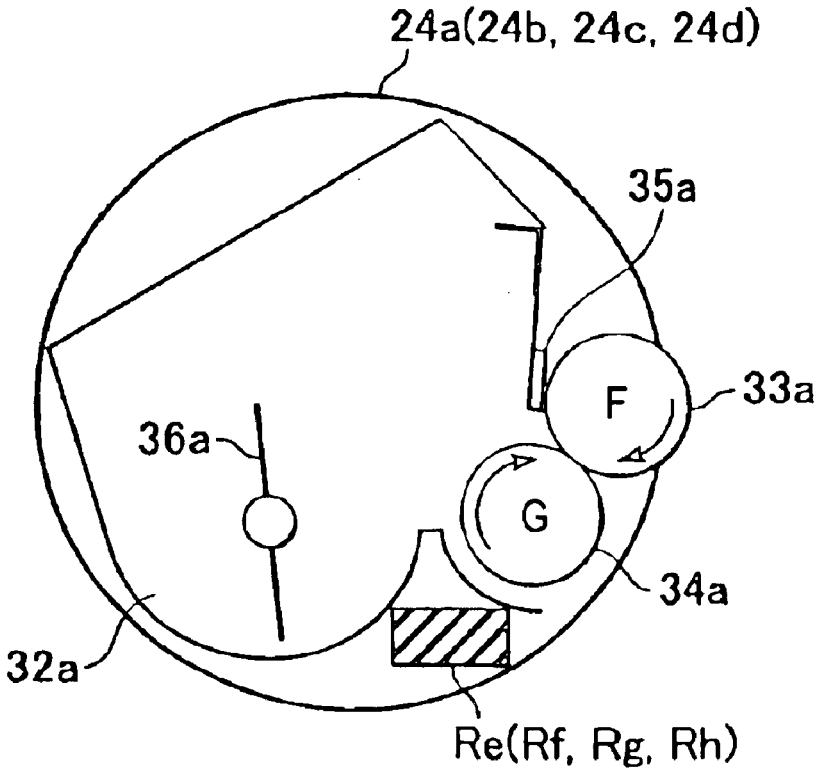
FIG. 2 is a diagram which illustrates the configuration of the cartridge of the present invention.

FIG. 2 is a configuration diagram which illustrates the developing cartridges 24*a*, 24*b*, 24*c*, and 24*d*, each of which contain different color toner, i.e., Y, M, C, or Bk, and are developing means according to the present embodiment, with each of the developing cartridges 24*a* through 24*d* having a configuration wherein the developing cartridge is detachably mounted on the rotary-type color printer which is the image formation apparatus shown in FIG. 1. In FIG. 1, the Y developing cartridge 24*a* for yellow which is at the detaching position can be detached in the upper direction indicated by the arrow C. With the rotary-type color printer shown in FIG. 1, detaching of the developing cartridge has to be performed at the detaching position, and in the event of detaching a developing cartridge other than the Y developing cartridge 24*a* in the drawing, i.e., 24*b*, 24*c*, and 24*d*, which are the M cartridge, C cartridge, and Bk cartridge, respectively, the rotary which holds the developing cartridge has to be rotated so that the cartridge, which is to be detached, is at the detaching position (the position 24*a* in the drawing).

Description will be made with regard to the Y toner developing cartridge 24*a* below in order to facilitate description, but the details of other color developing cartridges are also the same.

The developing cartridge 24*a* according to the present embodiment shown in FIG. 2 is an inverse developing device containing non-magnetic single-composition yellow (Y) toner as a developing agent within a toner container 32*a*. The developing cartridge 24*a* comprises a developing roller 33*a* which performs developing while contacting the photosensitive drum 21 and rotating in the direction of the arrow F in FIG. 2, a supplying roller 34*a* serving as a toner supplying means which supplies toner to the developing roller 33*a* by rotating in the direction G in the drawing, a developing blade 35*a* serving as a toner control means which controls the toner coating amount and the charge amount on the developing roller 33*a*, a mixing member 36*a* which mixes toner as well as supplying the toner to the supplying roller 34*a*, and the like.

Since the present embodiment employs the configuration wherein developing is performed by the developing roller 33*a* contacting the photosensitive drum 21 which is a rigid body, it is desirable that the above-described developing roller 33*a* have an elastic layer on the core. While the present embodiment employs silicone rubber as the elastic layer, other rubbers such as NBR rubber, isobutylene-isoprene rubber, natural rubber, acrylic rubber, hydrin rubber, polyurethane rubber, or the like, which are generally used, may be employed as the elastic layer. In general, the hardness of the above rubber can be reduced by increasing the amount of oil contained in the rubber.

In the event that the developing roller 33*a* has a single layer, and negative-charging-type toner is employed, polyurethane rubber, silicone rubber, NBR rubber, or the like, is suitably employed, in view of the nature of the rubber charging toner. Also, in the event that positive-charging-type toner is employed, fluororubber is suitably used.

Moreover, taking charging of the toner in consideration, in the event that a coating layer is provided on the outer circumference of the elastic layer, polyamide resin, urethane resin, silicone resin, acrylic resin, fluororesin, resin into which the above resins have been mixed, or the like, is suitably used.

Also, a well-known toner control member may be used for the developing blade 35*a* wherein the contact unit with the developing roller 33*a* is made of a metal member, rubber member, or resin member. With the present embodiment, the developing blade integrally comprises a thin board made of phosphor bronze and a resin member made of polyamide elastomer, and is pressed into contact against the developing roller 33*a*.

The toner mixed by the mixing member 36*a* is provided on the developing roller 33*a* by the friction of the developing roller 33*a* rotating in the direction of the arrow D against the supplying roller 34*a* rotating in the direction of the arrow E, as shown in FIG. 2. The toner on the developing roller 33*a* is charged by a desired amount by the developing blade 35*a*, which also controls the amount of toner, so that the desired amount of toner is carried on the developing roller 33*a*.

At the point of developing, upon the toner carried on the developing roller 33*a* reaching the position at which the rotating rotary contacts the photosensitive drum 21, i.e., the developing point, the electrostatic latent image formed on the circumference face of the photosensitive drum 21 is inverse-developed with the toner carried on the surface of the developing roller 33*a* by applying a developing bias voltage to the core of the developing roller 33*a*, whereby the electrostatic latent image is manifested as a toner image.

Note that with the embodiment according to the present invention, the developing method of the image formation apparatus is not restricted to the above-described contact-type developing method; rather, any developing method may be employed, not to mention a well-known non-contact-type developing method (jumping developing or the like).

Next, the storage units Re, Rf, Rg, and Rh, of the present embodiment, which are provided at the developing cartridges, i.e., 24*a* which is yellow Y, 24*b* which is magenta M, 24*c* which is cyan C, and 24*d* which is black Bk, will be described.

Each storage unit Re through Rh has a configuration wherein reading/writing of data is performed by communicating with a reading/writing unit 242 of the main unit. The configuration employs electromagnetic coupling wireless communication using antennas (not shown in drawings), and accordingly data can be write and read to and from the storage units Re through Rh without contact. The communication is performed with electromagnetic waves, and accordingly accurate communication can be performed without influence of dust or toner, even if the components making up the configuration are dirty with dust or toner. Each of the storage units Re through Rh are provided at the side of the container of the corresponding cartridge. Each of storage units Re through Rh store the data such as color information of the toner contained in the developing means of the cartridge, and so forth. The storage unit enables transmission and reception of data in the memory, which is a storage unit of the cartridge, to and from the control unit 100 via the reading/writing unit 242 provided within the main unit of the image formation apparatus, which is positioned so as to face the memory, at the cartridge detaching position in FIG. 1. The control unit 100 in the image formation apparatus can distinguish toner color contained in the developing cartridge, and judge the end of the life span of the cartridge, based upon the information received via the reading/writing unit 242.

In FIG. 1, in the event that the cartridge is at the position of the Y developing cartridge 24*a*, the control unit 100 of the main unit of the apparatus can read out the information stored in the storage unit Re. That is to say, in order to enable writing and reading of the data stored in other storage unit Rf through Rh to and from the control unit 100, each cartridge has to be shifted to the detaching position by rotating the rotary. Note that the memory is not restricted to the non-contact-type memory, and also contact-type memory which performs communication by coming into contact with the main unit of the image formation apparatus may be used for the storage units Re through Rh.

Figure 10:
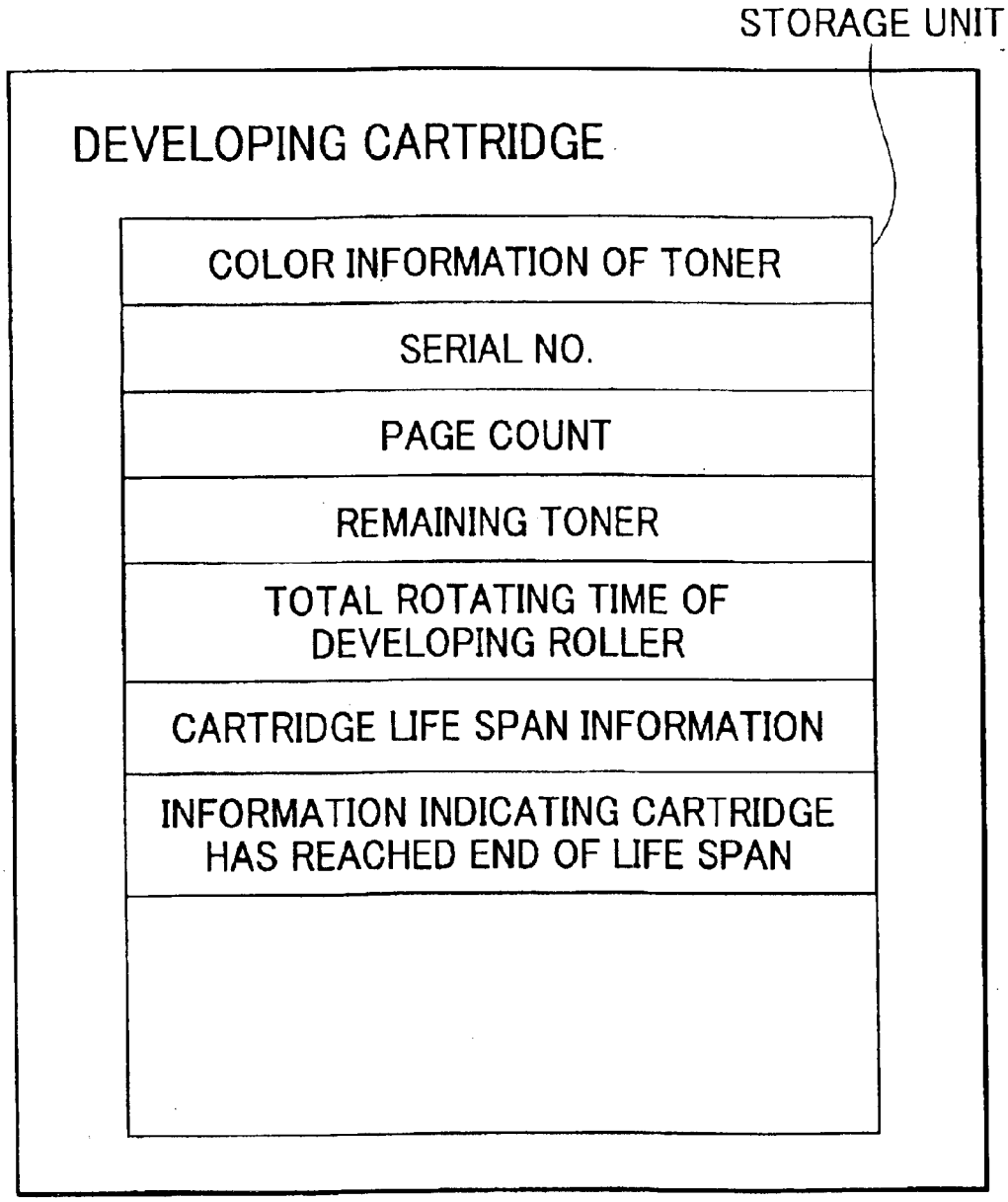
FIG. 10 is a diagram which illustrates the configuration of the storage unit of the cartridge of the present invention.

Note that the information as shown in FIG. 10 is stored in the storage unit. For example, in the case of the Y developing cartridge 24*a*, the storage unit stores information such as a serial number which has been given upon manufacturing of the Y developing cartridge, a page count number wherein the image formation is performed using the Y developing cartridge, the remainder of the toner in the Y developing cartridge, total rotation time of the developing roller (which is denoted by 33*a* in FIG. 2) of the Y developing cartridge, the cartridge life span information calculated therefrom, the information indicating the cartridge has reached the end of life span, and so forth, not to mention the color information of the toner in the Y developing cartridge. Also, the storage units of the M developing cartridge, the C developing cartridge, and the K developing cartridge, store similar information as the storage unit of the Y developing cartridge.

The processing at the beginning of using the developing cartridges 24*a* through 24*d* which are initially mounted to the main unit will now be described.

Each of the developing cartridges 24*a* through 24*d*, containing toners Y, M, C, Bk, respectively, are sequentially mounted to the predetermined mounting position of the rotary in the main unit of the image formation apparatus for each color.

In the event that none of the developing cartridges 24*a* through 24*d* are mounted to the main unit, first of all, the control unit 100 of the image formation apparatus rotates the rotary so that the part thereof to which the Y developing cartridge 24*a* is mounted is at the cartridge mounting position.

Next, in the event that the operations wherein a developing cartridge replacing cover not shown in drawings is opened, the developing cartridge is mounted within the rotary, and the replacing cover is closed again by a user, are detected, the control unit 100 of the image formation apparatus can determine the color of the toner contained in the cartridge which is mounted at that time by reading out the color information stored in the storage unit of the cartridge. In the event that the color information stored in the developing cartridge indicates yellow (Y), that is to say, in the event that the color information stored in the storage unit agrees with the color of the image formation unit at the mounting position, the rotary is rotated so that the cartridge 24*b* of the image formation unit M is at the mounting position which is the next mounting position of the rotary.

Note that the present embodiment has a configuration wherein the control unit 100 can read the data stored in the memory, which is a storage unit, at the cartridge detaching position, which is not the image formation position (developing position). That is to say, the memory can be accessed at a position other than the image formation position (developing position), and accordingly data can be read without the influence of scattering of the developing agent or electric noise due to the developing voltage.

Also, in the event that a color cartridge of a wrong color is erroneously mounted by a user, the error can be immediately detected. That is to say, the present embodiment has a configuration wherein data is read at the mounting position, and accordingly, loss of a great amount of time can be prevented. More specifically, with a configuration wherein the memory is accessed at the position different from the detaching position, in the event that a color cartridge of a wrong color is erroneously mounted, the time from erroneously mounting the cartridge until an erroneous mounting warning is given, such as time for rotating of the rotary to access the memory, time for returning to the detaching position in the event of mounting the wrong cartridge, and so forth, is wasted. The arrangement of the present embodiment prevents such waste of time.

Following the same procedure as described above, each of the developing cartridges 24*b*, 24*c*, and 24*d*, corresponding to a different color, are sequentially mounted, and the control unit 100 sets the state to "ready", wherein upon receiving a printing request, image formation operations begin, following confirming that the developing cartridges 24*b*, 24*c*, and 24*d*, have been mounted at the predetermined mounting positions of the image formation units within the rotary.

Next, control for preventing erroneous mounting of the developing cartridges in normal use will be described.

The control unit 100 reads out the color information stored in the storage unit Re through Rh, at a predetermined timing wherein the developing cartridges 24*a* through 24*d* may be detached or mounted, i.e., the timing of detecting detaching of the developing cartridges 24*a* through 24*d*, the timing wherein the power supply switch of the main unit is turned on, or the like, and sequentially confirms that the color of each image formation unit mounted on the rotary at that time agrees with the color information stored in the memory, by rotating the rotary so as to be at the cartridge mounting position, and sets the image formation operation to "ready", following confirmation that all the developing cartridges are mounted at their respective correct positions.

Also, in the event that the color information read out from the storage unit of the mounted developing cartridge does not agree with the color of the image formation unit on the rotary, the control unit 100 does not operate the image formation apparatus, and can give a warning to the effect that the cartridge is mounted at the wrong position, to a display unit 104 such as a liquid crystal display or the like of the image formation apparatus. An arrangement may be made wherein a warning message is displayed, or LEDs or the like is turned on or blinked, as the warning which reports to the user that the cartridge is mounted at the wrong position.

Figures 3, 3A, 3B:
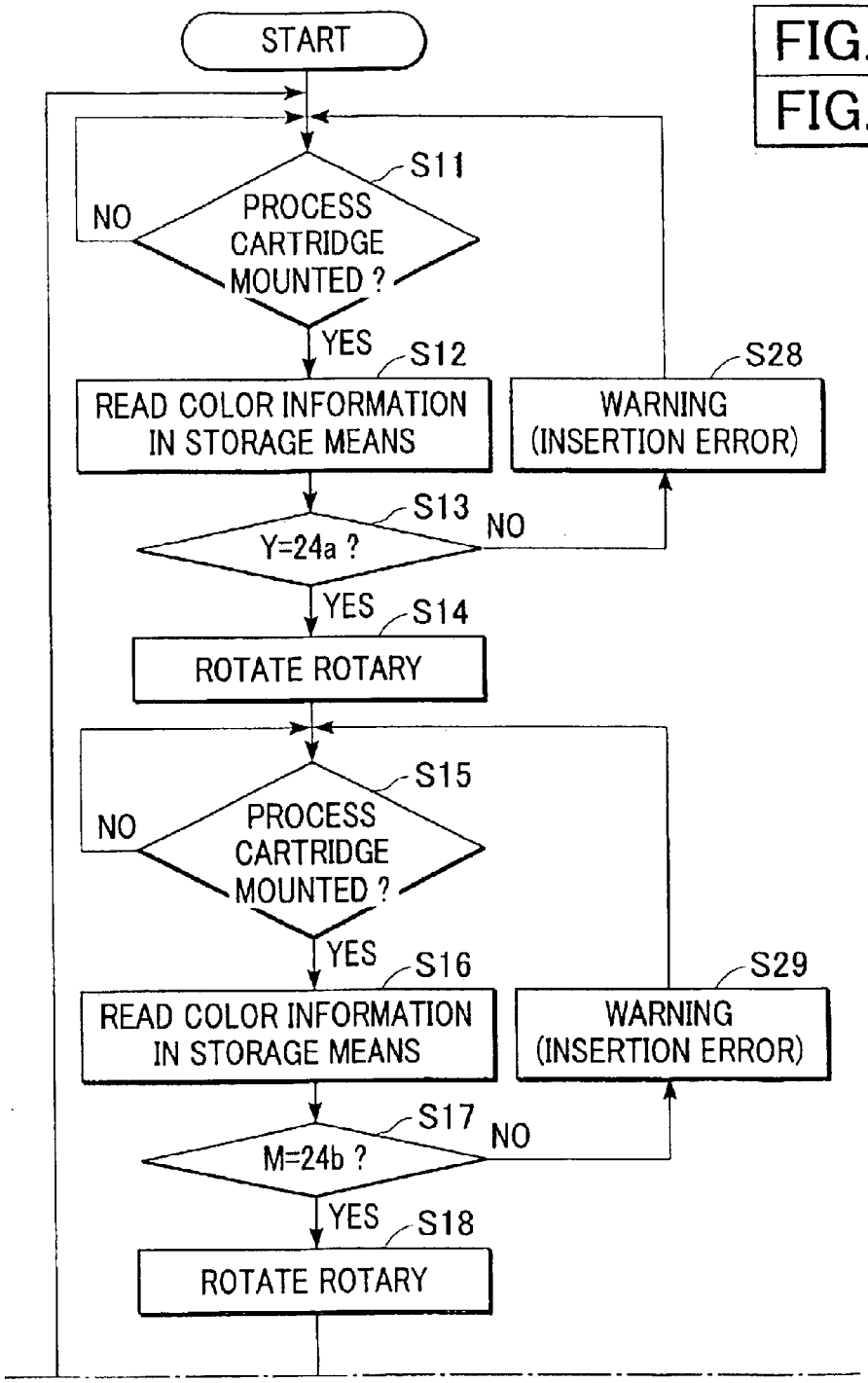
FIG. 3 is a flowchart which illustrates the control flow according to the first embodiment of the present invention.
Figure 3B:
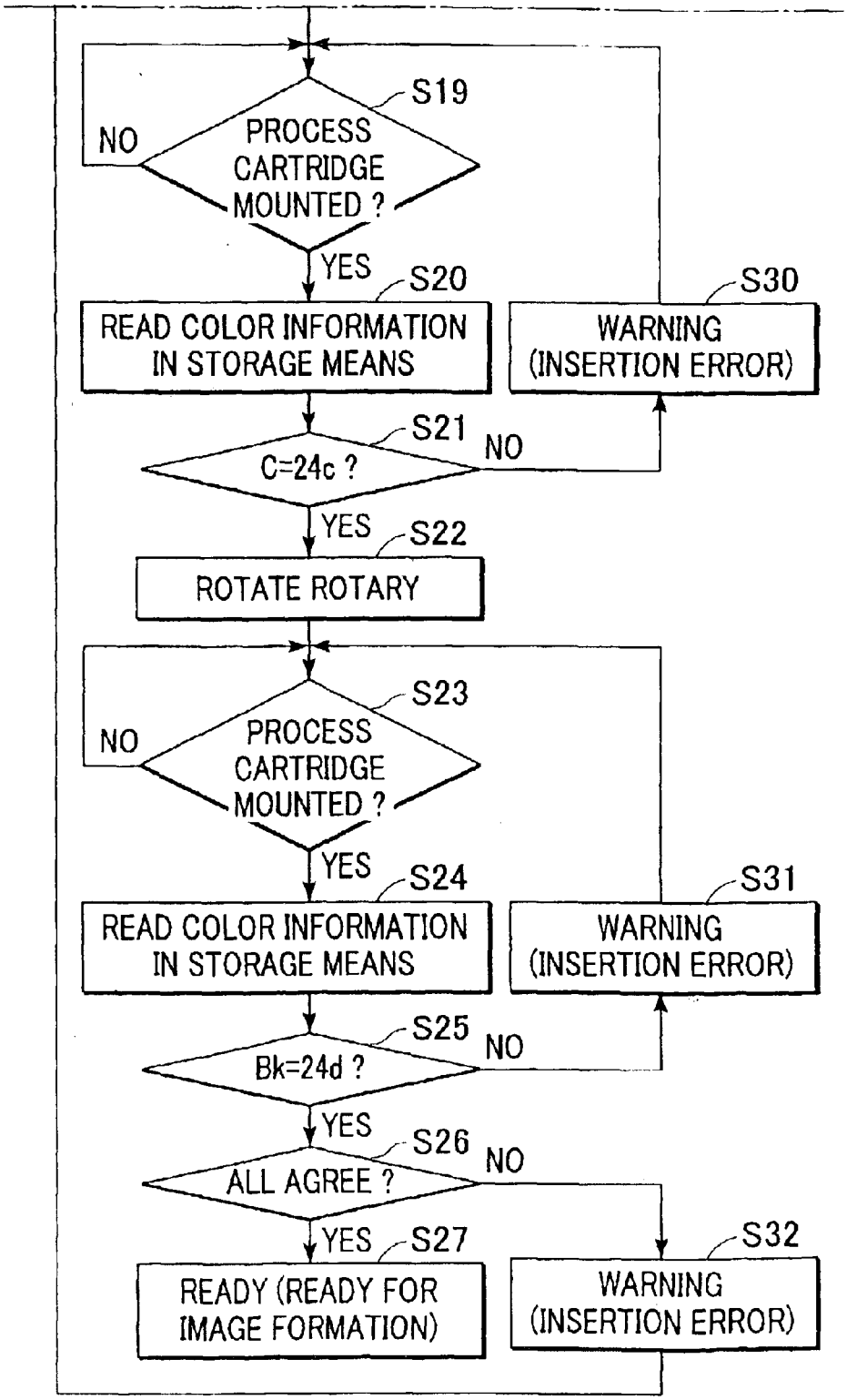

FIG. 3 is a flowchart which specifically illustrates the judgment with regard to the mounting position of the developing cartridge at a predetermined timing, such as initializing of the image formation apparatus by turning the power supply on or otherwise. Judgment procedures will be described further with reference to the drawing.

First of all, in the event of detecting that the developing cartridge is mounted at the Y image formation position within the rotary in the main unit of the color printer in a standby state (Yes in S11), the flow proceeds to Step S12, and the control unit 100 reads out the toner color information stored in the storage unit (S12). The control unit 100 judges whether or not the developing cartridge is mounted at the correct position, i.e., whether or not the developing cartridge 24*a* is mounted at the Y image formation unit (Y=24*a*) (S13), and in the event that the cartridge is mounted at the correct position (Yes in S13), the rotary is rotated so as to be at the next mounting position wherein the developing cartridge 24*b* can be mounted at the next M image formation position (S14), and waits until the cartridge is mounted.

In the event that the developing cartridge is not mounted at the correct position (No in S13), the flow proceeds to Step S28, and a warning of erroneous mounting is displayed.

In Step S15, in the event of detecting that the next cartridge is mounted (Yes in S15), the control unit 100 reads out the toner color information stored in the storage unit (S16), and confirms whether or not the developing cartridge 24*b* is mounted at the M image formation unit with the same procedures as Step 12 described above (M=24*b*) (S17), and in the event that the cartridge is mounted at the correct position (Yes in S17), the rotary rotates so as to be at the mounting position wherein the developing cartridge 24*c* is mounted at the C image formation position (S18), and waits until the next cartridge is mounted.

In the event that the judgment is made in Step S17 that the developing cartridge is not mounted at the correct position (No in S17), the flow proceeds to Step S29, and a warning of erroneous mounting is displayed.

In Step S19, in the event of detecting that the next cartridge is mounted (Yes in S19), the control unit 100 reads out the toner color information stored in the storage unit (S20), and confirms whether or not the developing cartridge 24*c* is mounted at the C image formation unit with the same procedures as Step 13 and S17 described above (C=24*c*) (S21), and in the event that the cartridge is mounted at the correct position (Yes in S21), the rotary rotates so as to be at the mounting position wherein the developing cartridge 24*d* is mounted at the Bk image formation position (S22), and waits until the next cartridge is mounted. In the event that judgment is made in Step S21 that the developing cartridge is not mounted at the correct position (No in S21), the flow proceeds to Step S30, and a warning of erroneous mounting is displayed.

In Step S23, in the event of detecting that the last developing cartridge is mounted (Yes in S23), the control unit 100 reads out the toner color information stored in the storage unit (S24), and confirms whether or not the developing cartridge 24*d* is mounted at the Bk image formation unit with the same procedures as Steps S13, S17, and S21, described above (Bk=24*d*) (S25), and in the event that the cartridge is mounted at the correct position (S25-YES), the flow proceeds to Step S26, and set the state to "ready" wherein the image formation operations can be begun (S27) in a state following confirming that all the developing cartridges 24*a* through 24*d* are mounted at the correct positions corresponding to the mounting positions of the color image formation units within the rotary (S26). In the event that judgment is made that the developing cartridge is not mounted at the correct position in Steps S25 and S26, the flow proceeds to Steps S31 and S32, respectively, and a warning of erroneous mounting is displayed.

In the event that the color information read out from the storage unit of the mounted developing cartridge does not agree with the color of the image formation unit of the rotary, the control unit 100 does not set the state to "ready", and instead gives a warning that the developing cartridge is mounted at the wrong position, to a display unit 101 of the image formation apparatus or the display unit 104 of the connected host 103, such as a CRT, a liquid crystal display, or the like, via a printer driver or the like (S28 through S32).

In the event that the Y, M, C, or Bk developing cartridge is replaced according to the warning, the processing is performed following the procedures beginning at Step S11, S15, S19, or S23, described above.

Also, in the event that one of the mounted developing cartridges is replaced due to the end of life span thereof, judgment regarding the developing cartridge mounting is processed as described above, except for one respect wherein processing is performed only for the developing cartridge which has been mounted following replacing.

Also, with the image formation apparatus according to the present embodiment, in the event that the control unit 100 detects that the cartridge has reached the end of the life span thereof due to running out of toner or the like, the developing cartridge which has reached the end of life span is automatically driven in a rotational manner so as to be at the detaching position at a predetermined timing. At the same time, the control unit 100 is arranged to read out the color information from the storage unit of the cartridge wherein the end of life span has been detected, and give a warning prompting the user to replace the developing cartridge of which color has been read out. Thus, in the event that the cartridge reaches the end of the life span, the user can immediately replace the cartridge which has reached the end of the life span thereof.

For example, in a case that the end of life span of the M developing cartridge is detected, and is rotationally driven so as to be at the detaching position, in the event that the user replaces the cartridge which has reached the end of life span with a new cartridge, processing is performed such that the flow skips to Step S26, following performing the processing beginning at Step S15 and on through Step S18. That is to say, in the event that only one cartridge is replaced, the processing is controlled so as to skip the processing for other colors. Thus, the user can easily replace the cartridge which has reached the end of life span without mistake of the color, and accordingly usability such as reduction of troublesome tasks and so forth is improved.

Figure 11:
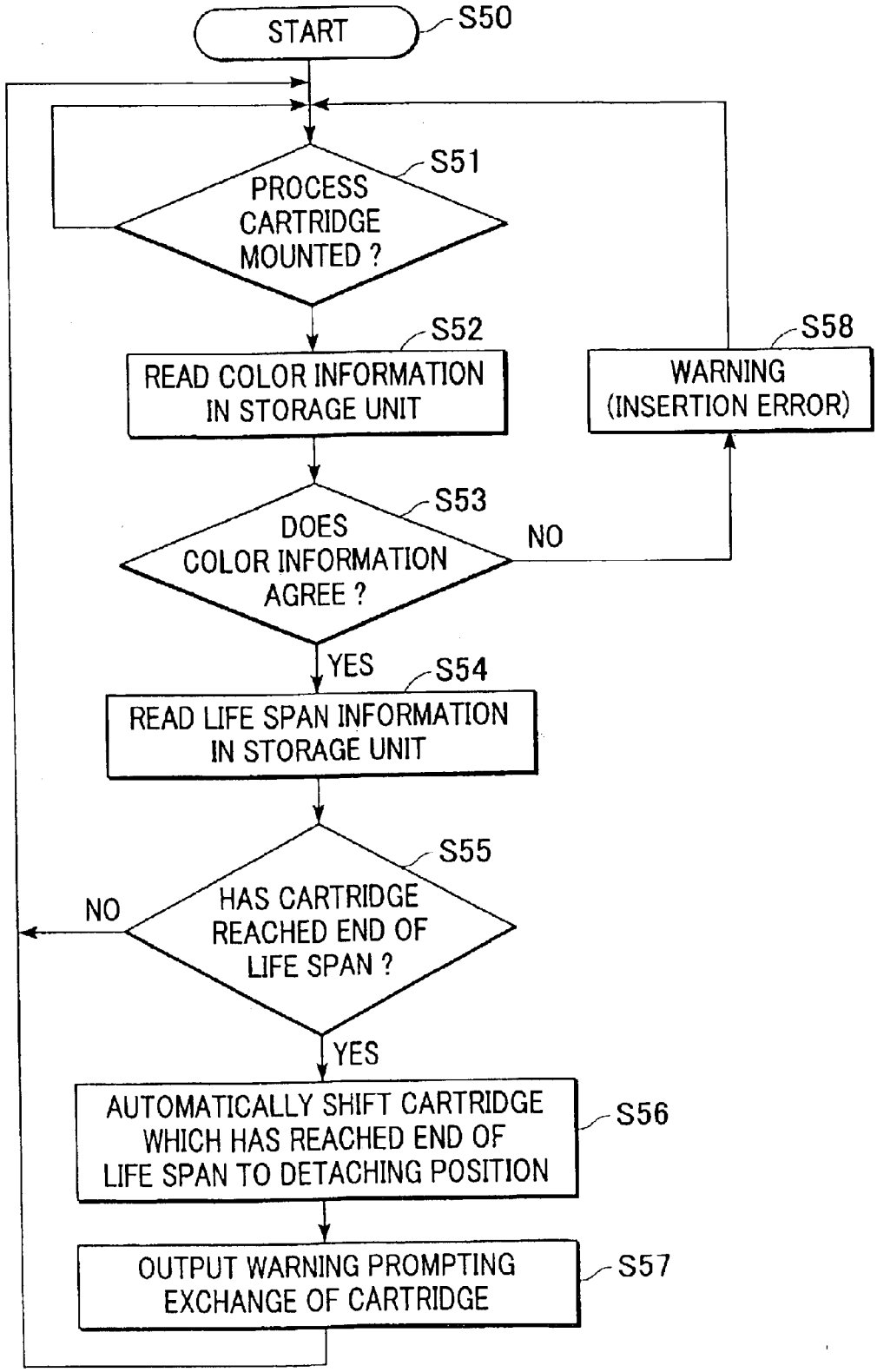
FIG. 11 is a flowchart which illustrates the control flow of the first embodiment of the present invention.

FIG. 11 is a diagram which illustrates a sequence of detection of the end of life span, and further an erroneous mounting detection sequence for the developing cartridges shown in FIG. 3. FIG. 11 is a flowchart which illustrates a replacing sequence for the developing cartridge which has reached the end of life span, at the time of initialing the image formation apparatus, such as turning on of the power supply, the same as shown in FIG. 3. The replacing sequence for the developing cartridge which has reached the end of the life span thereof is performed at a predetermined timing such as turning on of the power supply, opening or closing a door, or the like, based upon control programs stored in ROM or the like within the control unit 100. First of all, in Step S50, the detection sequence begins, and in Step S51, judgment is then made whether or not the cartridge is mounted at the image formation position. In the event that detection is made that the cartridge is mounted there, in Step S52, the toner color information stored in the storage unit of the cartridge is read out. The control unit 100 judges whether or not the cartridge is mounted at the correct position based upon the toner color information which is read out (the same as the flowchart shown in FIG. 5). In the event that judgment is made that the cartridge is not mounted at the correct position, a warning indicating erroneous mounting is output in Step S58. Also, in the event that the cartridge is mounted at the correct position, the information with regard to the life span of the cartridge is read out from the storage unit in the next Step S54. In Step S55, judgment is made whether or not the cartridge has reached the end of life span based upon the life span information which has been read out. In the event that judgment is made that the cartridge has reached the end of life span, the instruction signals are transmitted from the control unit 100 to the motor M1, and the rotary 24 is driven by the motor M1 based upon the instruction signals, so that the cartridge which has reached the end of life span is automatically shifted to the detaching position in Step S56. In Step S57, a warning prompting replacing of the cartridge is output to the host 103 or the display unit 101 following the above-described shift.

Also, with the present embodiment, an arrangement may be made wherein, in the event that the detection is made that the cartridge has reached the end of life span due to running out of toner, or the like, the information is stored in the storage unit, and accordingly, in the event that the user mounts the process cartridge which has reached the end of life span again by mistake, information thereof is read out from the storage unit, and a warning prompting replacing of the cartridge is immediately output.

Note that in the event that judgment is made whether or not the cartridge has reached the end of life span, the remaining toner is detected by means for detecting the remaining toner, such as an optical detector or the like, not shown in drawings, and in the event that the detected toner remainder reaches a predetermined value (threshold value), the control unit 100 judges that the cartridge is running out of toner, controls writing of the information indicating that the cartridge is running out of toner to the storage unit, and outputs a message (signals) prompting replacement of the cartridge to the host 103 or the display device 101 based upon the information. Also, as another method different from the method which detects the toner remainder as described above, the total cycle time of the developing roller is stored in the storage unit by being updated, and in the event that the total cycle time reaches a predetermined value (threshold value), the control unit 100 judges that the cartridge has reached the end of life span, and outputs a message (signals) prompting replacement of the cartridge to the host 103 or the display device 104.

Note that the above-described predetermined value (threshold value) for judging whether or not the cartridge is running out of toner, or the above-described predetermined value (threshold value) with regard to the total cycle time of the developing roller, may be stored in the storage unit of the cartridge, or in ROM within the control unit 100. Also note that the judgment whether or not the cartridge has reached the end of life span by comparison between the detected remaining toner and the predetermined value, or by comparison between the total cycle time of the developing roller and the predetermined value, is performed during or following the image formation operations, at a appropriate timing.

While an example wherein the developing cartridges, each of which have a different color, are mounted on the rotary, is described with the present embodiment, it is needless to say that an arrangement wherein each color process cartridge mounted further integrally comprises a photosensitive member, a charging means, and a cleaning means, has the same effects.

As described above, with the present embodiment, accurate communication can be performed all at times without influence of soiling due to scattered toner or electric noise from developing bias. Also, in the event that the cartridge has reached the end of the life span thereof, the user can immediately replace the cartridge which has reached the end of the life span.

(Second Embodiment)

Figure 9:
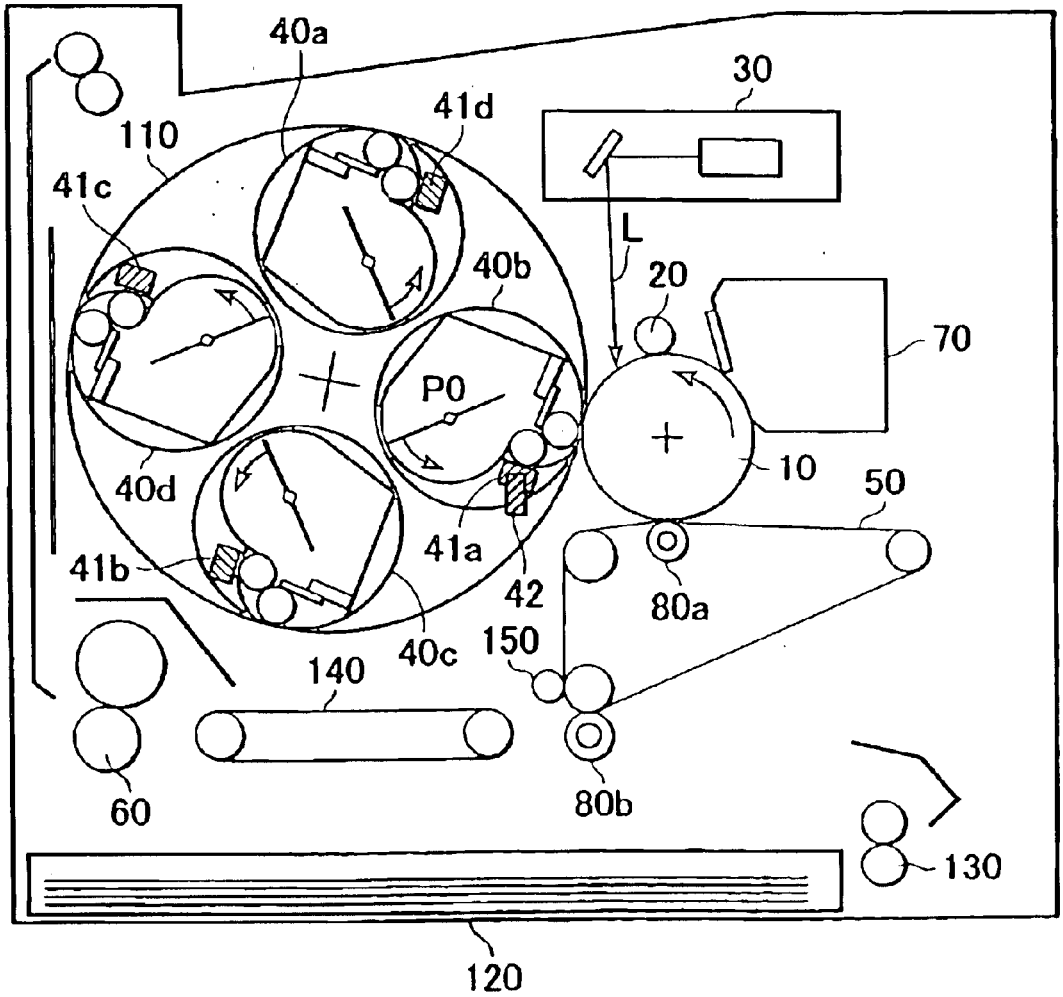
FIG. 9 PRIOR ART
FIG. 9 is a diagram which illustrates the configuration of conventional arrangement.

A color printer which is a second embodiment of the present invention will be described with reference to FIG. 4. The overall configuration and functions according to the present embodiment are generally the same as those of the rotary-type color printer as shown in FIG. 9, so the same portions are denoted by the same reference symbols, and detailed description thereof will be omitted.

The present embodiment has a configuration wherein writing and reading to and from NVRAM is performed not at the detaching position of the process cartridge, but at a position other than the detaching position, which is different from the above-described first embodiment.

Figure 4:
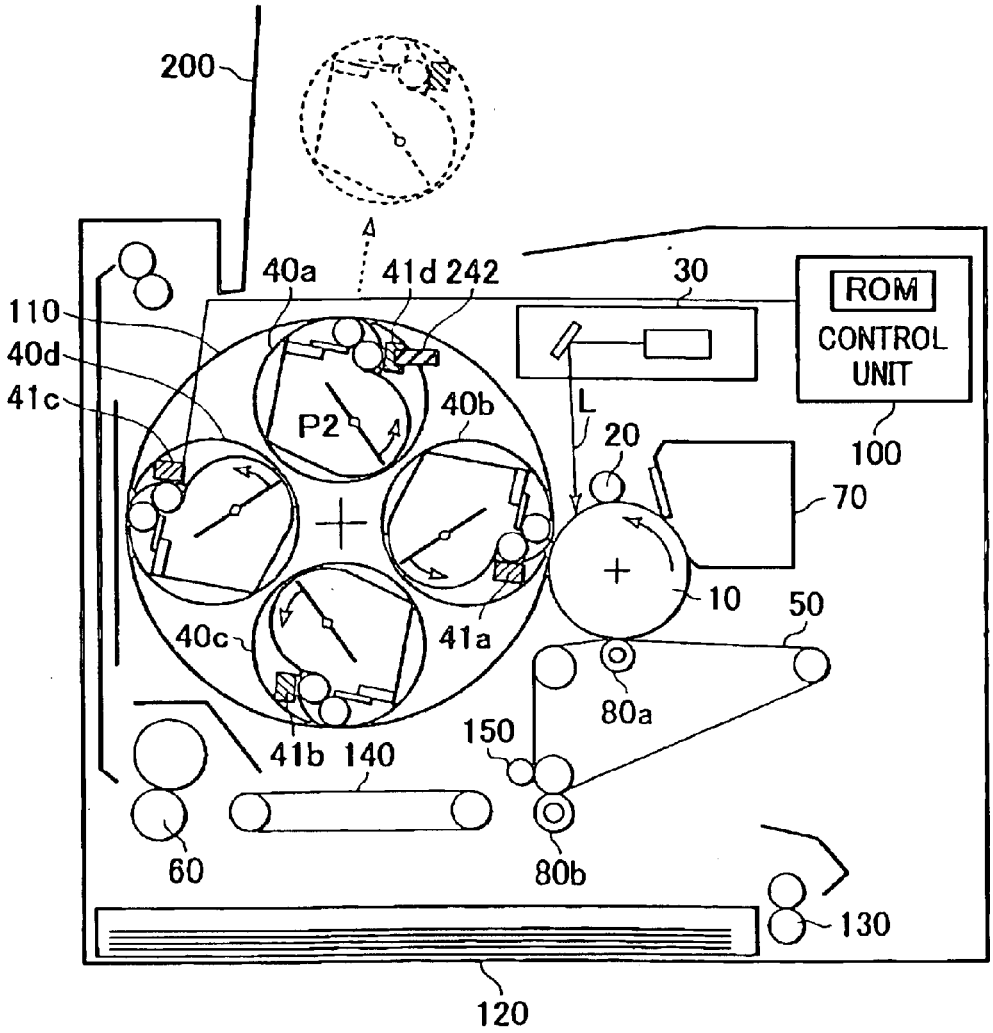
FIG. 4 is a diagram which illustrates the configuration of the second embodiment of the present invention.

FIG. 4 illustrates the detaching position in detail, and reference character P2 denotes the cartridge detaching position. That is to say, the cartridge which has stopped at a position P2 is picked up externally from the apparatus by opening a cover 200 at the top side of the apparatus, and extracting in the direction of the arrow shown in the drawing.

With the present embodiment, access of the storage unit is performed not at the position at which the cartridge is detached, and a reading/writing position 242 may be the position wherein the detaching position is rotated by $\theta=90\times n(°)$ (n=1, 2, 3) around the shaft of the support member. That is to say, an arrangement may be made wherein, in the event that one of the multiple cartridges is at the detaching position, access is performed at the positions of the other cartridges. The number of cartridges is four in this case, and accordingly the angle $\theta$ is arranged so as to be $\theta=90\times n(°)$ (n=1, 2, 3), but in the event that the number of the cartridges is three, the angle $\theta$ is arranged so as to be $\theta=120\times n(°)$ (n=1, 2), and in the event that the number of the cartridges is five, the angle $\theta$ is arranged so as to be $\theta=72\times n(°)$ (n=1, 2, 3, or 4). That is to say, in general, in the event that the number of the cartridges is N, access of the storage unit is performed at the positions wherein the mounting position is rotated by $\theta=360\times n/N(°)$ (n=1, 2, . . . , or N).

Thus, with this configuration, while access of the storage unit can not be performed at the detaching position for replacement of the cartridge, communication errors due to replacement of the cartridge while communicating can be prevented in cases that the communication is performed at the detaching position. Also, memory access is performed at a position away from the developing position, as with the first embodiment, and accordingly accurate communication can be performed at all times without the influence of scattered toner or the influence of electric noise.

While description is not made here regarding the motor which is a driving unit for rotationally driving the rotary, or the configuration for moving the rotary, the configuration and the operations thereof are the same as those of the first embodiment described above.

Note that with the present embodiment, control for prevention of erroneous mounting of the cartridge, or detection of the life span of the cartridge, is also performed by the control unit 100, as with the first embodiment. Also, the access of the storage unit of the cartridge may employ a non-contact method, as well as a contact method.

(Third Embodiment)

Figure 5:
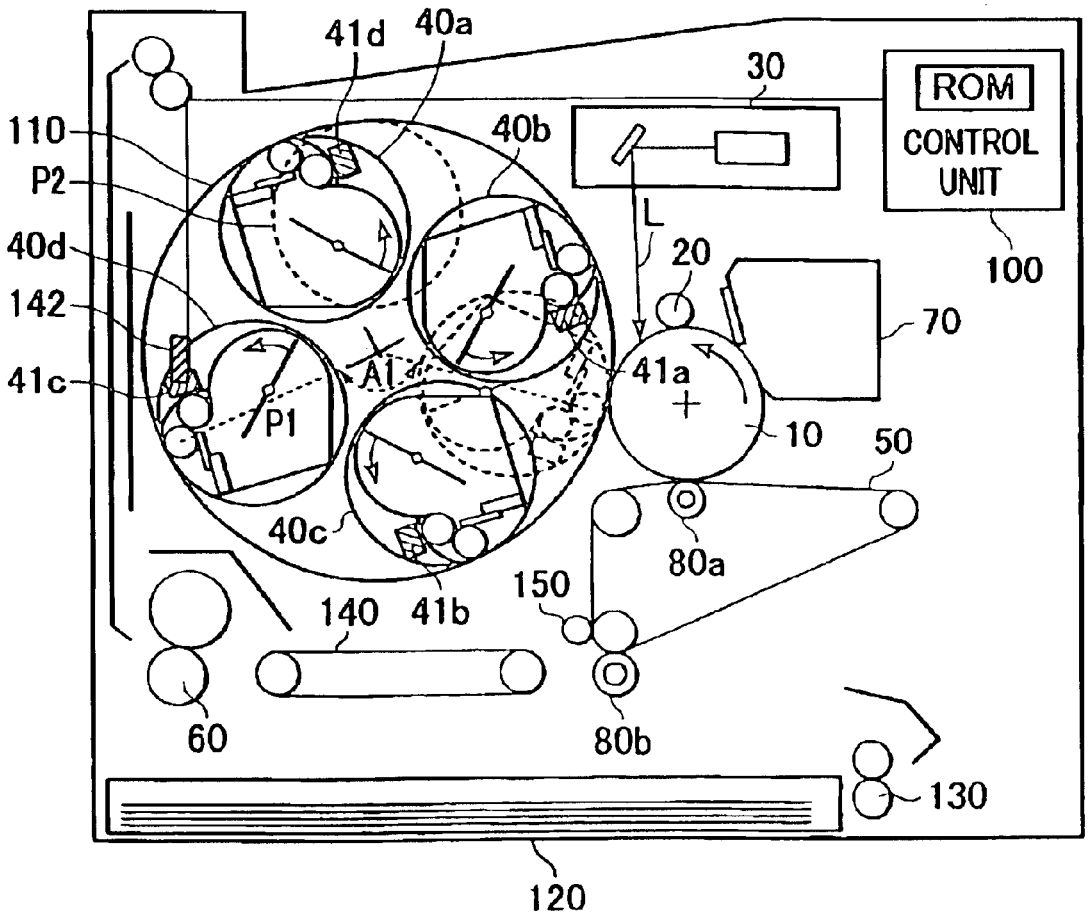
FIG. 5 is a diagram which illustrates the configuration of the third embodiment of the present invention.

FIG. 5 illustrates a rotary-type color printer as a third embodiment of the image formation apparatus according to the present invention. The overall configuration and functions of the color printer according to the present embodiment are generally the same as the rotary-type color printer shown in FIG. 9, and accordingly the same portions are denoted by the same reference symbols, and detailed description thereof will be omitted.

The present embodiment has a configuration wherein access of the memory, which is the storage unit of the developing cartridge, is performed at a position different from the detaching position of the cartridge, and other than the developing position, which is different from the first and the second embodiments.

The present printer includes four process cartridges 40*a*, 40*b*, 40*c*, and 40*d*, which have flash memory serving as storage units, and four kinds of developing agents, respectively, and a rotational supporting member 110 as a cartridge supporting means for rotationally supporting these process cartridges. A latent image on an image carrying member is then manifested by a developing agent in the state wherein one of multiple developing cartridges is disposed at the image formation position by the rotational supporting member (rotational holding member) 110. Access of the flash memory provided at the process cartridges is performed at a position other than the image formation position. For example, taking the flash memory of the Y developing cartridge 24*a* as an example of each flash memory, the flash memory stores information with regard to the cartridge such as a serial number provided at manufacturing of the Y developing cartridge, a page count number wherein image formation is performed using the Y developing cartridge, the amount of toner remaining within the Y developing cartridge, total cycle time of the developing roller 33*a* of the Y developing cartridge, cartridge life span information calculated therefrom, information indicating that the cartridge has reached the end of life span, and so forth, not to mention the color information of toner within the Y developing cartridge, as information stored in the storage unit, as with the first embodiment. The storage units of the M developing cartridge, C developing cartridge, and Bk developing cartridge, each store information similar to the storage unit of the Y developing cartridge.

As shown in FIG. 5, with the present embodiment, a reading/writing position 142 is provided so that reading and writing from and to the flash memory 41*a*, 41*b*, 41*c*, and 41*d*, can be performed at the position P1 where the image formation position (which is denoted by a dashed line in the drawing), at which each of the cartridges 40*a*, 40*b*, 40*c*, and 40*d* face the photosensitive drum 10, is rotated by A1=135° clockwise.

The positions wherein the developing position is rotated by 90, 180, and 270° clockwise, are defined as cartridge stop positions. Accordingly, the degree A1 with regard to the position P is set to 135°, so that the position P does not overlap the stop positions. The angle corresponds to the position wherein the rotary can stopped and reliable communication can be performed, by the placement configuration of each unit, or the like, and the angle is not restricted to the above angle (135°).

Also, as shown in the description of the first embodiment, reliable communication can be performed without the influence of dust from the outside or the like (in the case of contact-type communication) by communicating at a position different from the detaching position.

Note that the position P2 shown in FIG. 5 denotes the detaching position of the cartridge.

With the present embodiment, instruction signals are transmitted from the control unit 100 to the motor M1, and the rotary 110 can be rotationally shifted to one of three states, i.e., the image formation position, the access position for the storage unit which is flash memory, and the detaching position.

With the present embodiment, accurate communication can be performed at all times without the influence of soiling due to scattered toner from developing and electric noise due to the developing voltage.

Though the configuration of the motor, which is a driving unit for rotationally driving the rotary, and the configuration of a means for shifting the rotary, have not been described in the present embodiment, the same configuration and operations as described in with the first embodiment are employed.

Note that also, with the present embodiment, control of prevention of the cartridge from erroneous mounting or detection of the life span of the cartridge is performed by the control unit 100, the same as with the first embodiment.

Also, access of the storage unit of the cartridge may employ a non-contact method, as well as a contact method.

(Fourth Embodiment)

Figure 6:
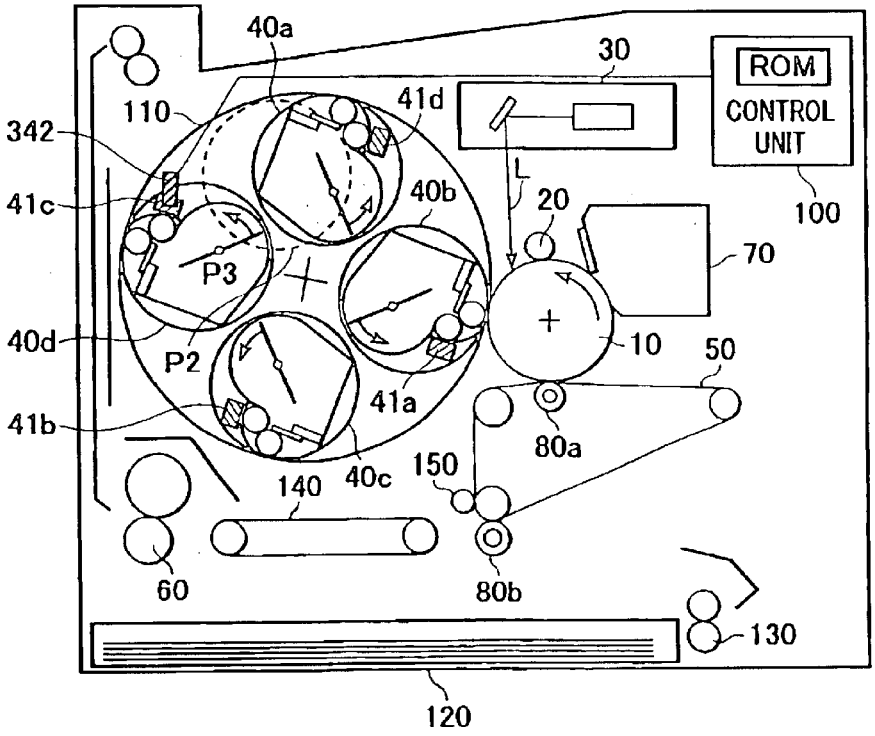
FIG. 6 is a diagram which illustrates the configuration of the fourth embodiment of the present invention.

Referring to FIG. 6, a color printer according to a fourth embodiment of the present invention will be described. The overall configuration and functions of the color printer according to the present embodiment are generally the same as the rotary-type color printer shown in FIG. 9, and accordingly the same portions are denoted by the same reference symbols, and detailed description thereof will be omitted.

With the present embodiment, writing and reading to and from the NVRAM is performed at the position wherein the developing position of the developing cartridge is rotated by $\theta=90\times n(°)$ (n=1, 2, 3) around the shaft thereof, which is different from the above-described first and second embodiments.

Here, with the present embodiment, a reading/writing unit 342 is provided so as to perform reading and writing from and to the non-volatile storage unit at a position P3 where the developing position at which the cartridge faces the photosensitive drum is rotated by 180°.

Thus, in addition to the advantages of the above-described first and second embodiments, the present embodiment has advantages in that there is no load for the control unit to access the storage unit via the reading/writing unit upon detaching.

With the present embodiment, while memory access is performed at the position wherein the developing position is rotated by 180°, the rotating angle θ from the image formation position (developing position) is not restricted to the above angle (180°). In the event that the number of the cartridges is four, θ may be one of 90°, 180°, or 270°. That is to say, in the event that the number of cartridges is N, $\theta=360°\times n/N$ (n=1, 2, . . . or (N−1)).

Note that the position P2 shown in FIG. 5 is the detaching position of the cartridge. As shown in the drawings, the detaching position is a position different from the image formation position.

While the configuration of the motor, which is a driving unit for rotationally driving the rotary, and the configuration of means for shifting the rotary, have not been described in description of the present embodiment, the same configuration and operations as described in description of the first embodiment are employed.

For example, taking the information stored in the non-volatile storage unit of the Y developing cartridge 24*a* as an example of that of each cartridge, the storage unit stores information with regard to the cartridge such as a serial number provided at manufacturing of the Y developing cartridge, a page count number wherein image formation is performed using the Y developing cartridge, the amount of toner remaining within the Y developing cartridge, total cycle time of the developing roller 33*a* of the Y developing cartridge, cartridge life span information calculated therefrom, information indicating that the cartridge has reached the end of life span, and so forth, not to mention the color information of toner within the Y developing cartridge. The storage units of the M developing cartridge, C developing cartridge, and the K developing cartridge, store information similar to that in the storage unit of the Y developing cartridge.

Note that also, with the present embodiment, control to prevent erroneous mounting of the cartridge, and detection of the life span of the cartridge, is performed by the control unit 100, the same as with the first embodiment.

Also, access of the storage unit of the cartridge may employ a non-contact method, as well as a contact method.

(Fifth Embodiment)

A color printer will be described as a fifth embodiment of the present invention, with reference to FIG. 7. The overall configuration and functions of the color printer according to the present embodiment are generally the same as those of the rotary-type color printer shown in FIG. 9, and accordingly the same portions are denoted by the same reference symbols, and detailed description thereof will be omitted.

With the present embodiment, a process cartridge is an image formation cartridge integrally comprising at least a photosensitive member, besides a developing agent container.

With the color printer of the present embodiment, image formation cartridges a, b, c, and d, each of which integrally comprise a photosensitive drum, a primary charger, a developer, a cleaning device, and toner, are disposed around a rotational supporting member 111. First of all, the image formation cartridge "a" containing yellow toner is rotated so as to be at the position facing an intermediate transfer belt 105. Here, a photosensitive drum 1*a* within the image formation cartridge "a" is driven in the direction of the arrow by a driving means not shown in drawings, and is uniformly charged by a primary charger 2*a*. Next, a laser beam L generated according to image patterns of yellow is cast on the photosensitive drum 1*a* by an exposure device 103, thereby forming a latent image on the photosensitive drum 1*a*. Upon the photosensitive drum 1*a* proceeding further in the direction of the arrow, a toner image is formed on the photosensitive drum by a developer 4*a*. The intermediate transfer belt 105 is rotated in the direction of the arrow at generally the same speed as the photosensitive drum 1*a*, and primary transfer of the toner image which has been formed and carried on the photosensitive drum la onto the outer circumference of the intermediate transfer belt 105 is performed by a primary transfer bias applied to a primary transfer roller 108*a*. On the other hand, the residual toner on the photosensitive drum 1*a* following transferring is cleaned up by a cleaning device 7*a* employing a well-known blade method. The above-described processing is successively performed for yellow, magenta, cyan, and black, thereby forming a toner image in multiple colors on the intermediate transfer belt 105. Next, a recording medium is supplied from a recording medium cassette 112 by a pickup roller 113 at a predetermined timing. At the same time, a secondary transfer bias is applied to a secondary transfer roller 108*b*, thereby transferring a toner image from the intermediate transfer belt 105 onto the recording medium.

Moreover, the recording medium is transported to a fixing unit 106 by a transporting belt 114, and is fixed by melting, thereby obtaining a color image. Also, the residual toner following transferring on the intermediate transfer belt 105 is charged by an intermediate transfer cleaning roller 115, and is reverse-transferred onto the photosensitive drum at the next transferring time.

Here, NVRAM 41*a*, NVRAM 41*b*, NVRAM 41*c*, and NVRAM 41*d* (storage units) for storing information regarding the cartridges are provided to the sides of the cartridges a, b, c, and d, respectively. Also, with the present embodiment, the reading/writing means 442 of the main unit is provided so as to perform reading and writing from and to the NVRAM 41*a*, NVRAM 41*b*, NVRAM 41*c*, and NVRAM 41*d*, at a position P4 where the position at which the image formation cartridge faces the intermediate transfer belt is rotated by 180°.

For example, taking the information stored in the storage unit of the Y process cartridge 24*a* as an example of that of each cartridge, the storage unit stores information with regard to the cartridge such as a serial number provided at manufacturing of the Y process cartridge, a page count number wherein image formation is performed using the Y process cartridge, the amount of toner remaining within the Y process cartridge, total cycle time of the developing roller 33*a* of the Y process cartridge, cartridge life span information calculated therefrom, information indicating that the cartridge has reached the end of life span, and so forth, not to mention the color information of toner within the Y developing cartridge. The storage units of the M process cartridge, C process cartridge, and the K process cartridge, store similar information as the storage unit of the Y process cartridge.

With the present embodiment, in the event of using the image formation cartridges each of which integrally comprise a photosensitive drum and a developer, accurate communication with a non-volatile storage unit can be performed at all times, as with the above-described embodiments, and also, the complexity of cartridge rotation/stop control can be reduced.

Also, with the present embodiment, while memory access is performed at the position wherein the image formation position (developing position) is rotated by 180°, memory access may be performed at various positions other than the developing position, as with the above-described first, second, and third embodiments. In the event that memory access is performed, the same advantages can be obtained, for example, at the position wherein the developing position is rotated by 90° or 270°, and also at the cartridge detaching position or the position wherein the cartridge detaching position is rotated by 90°, 180°, or 270°.

Figure 7:
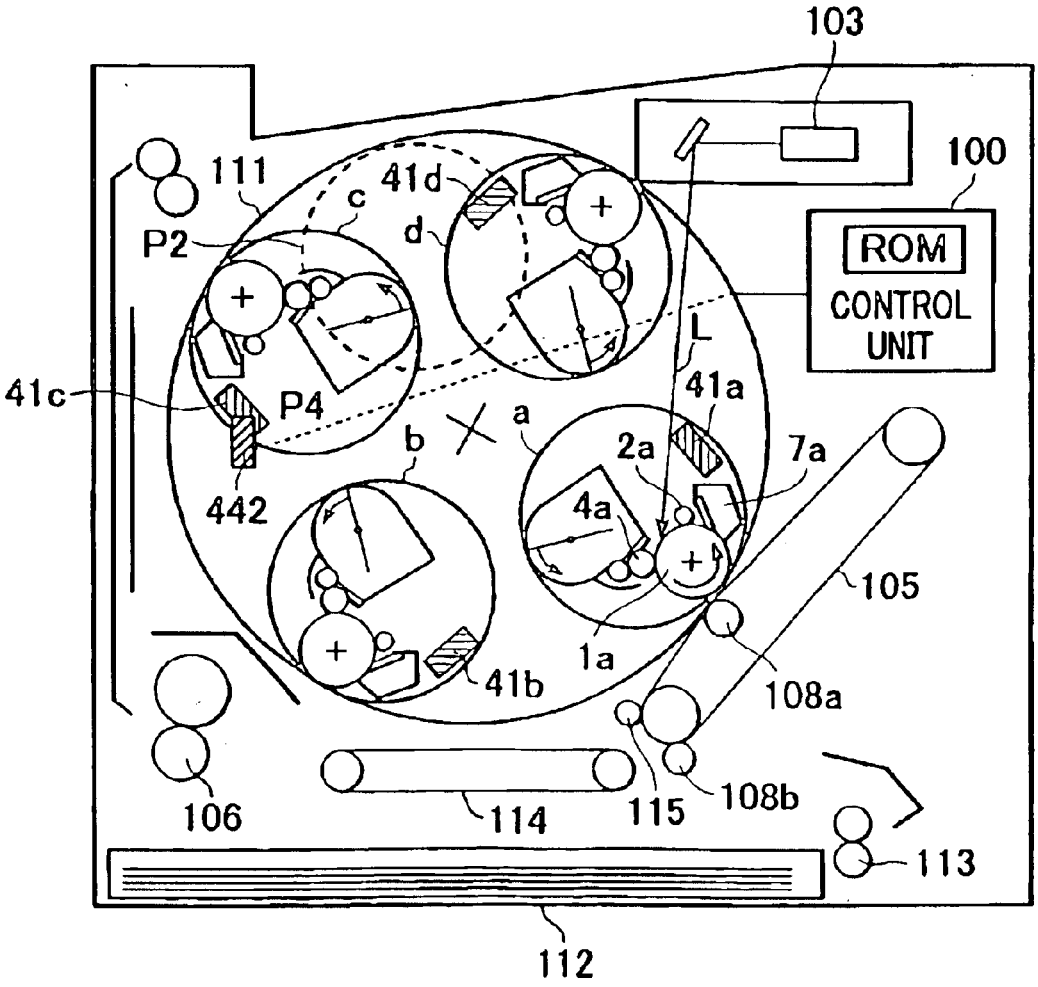
FIG. 7 is a diagram which illustrates the configuration of another embodiment of the present invention.

Note that the position P2 shown in FIG. 7 denotes the detaching position of the cartridge. As shown in the drawing, the detaching position is a position different from the image formation position.

Here, with the present embodiment, though the motor which is a driving unit for rotationally driving the rotary, and the configuration for moving the rotary, have not been described, the same configuration and control as with the first embodiment are employed.

Also, the same control as with the first embodiment is performed with regard to control of detection of erroneous mounting of the cartridge and the detection of the life span of the cartridge. Note that control for preventing the erroneous mounting of the cartridge and control for detection of the cartridge life span is performed by the control unit 100, the same as with the first embodiment.

Also, access of the storage unit of the cartridge may employ a non-contact method, as well as a contact method.

(Other Embodiments)

With the above-described first through fourth embodiments, while NVRAM is employed as non-volatile storage units in view of usability or cost, other storage devices which can rewritably hold and store signal information may be employed. For example, a electric storage unit such as ordinary RAM, rewritable ROM, or the like, or a magnetic storage unit such as magnetic recording medium, magnetic bubble memory, magneto-optical memory, or the like, may be employed.

Also, with the above-described embodiments, while communication is performed by a non-volatile storage unit in contact with a reading/writing means, the same advantages can be obtained employing a non-contact type communication method as well.

Figure 8:
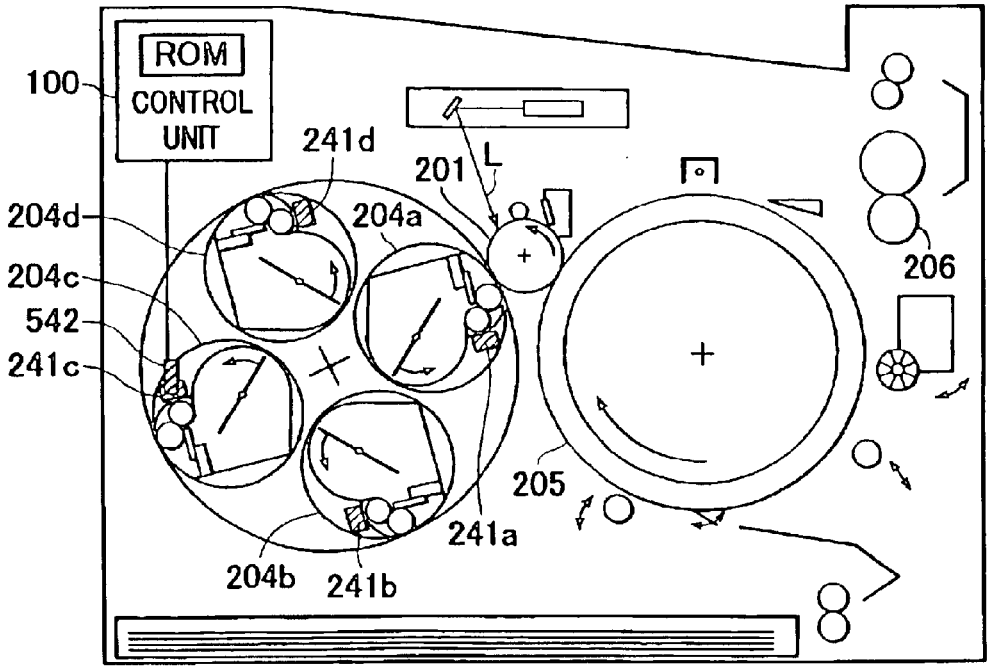
FIG. 8 is a diagram which illustrates an example of the configuration of a multi-transfer-type color printer.

Note that with the above-described first through fourth embodiments, while description has been made with the color printer as an intermediate-transfer-type color printer which uses an intermediate transfer medium, the same effects can be obtained by employing a multi-transfer-type color printer which forms images by consecutively transferring toner images on a photosensitive drum 201 onto a recording medium carried on a recording medium carrier 205, as shown in FIG. 8. Here, in FIG. 8, reference numerals 204*a*, 204*b*, 204*c*, and 204*d*, denote developing cartridges, respectively, reference numerals 241*a*, 241*b*, 241*c*, and 241*d*, denote non-volatile storage units, respectively, reference numeral 542 denotes a reading/writing means, and reference numeral 206 denotes a fixing unit.

Note that the present invention may be applied to a system made up of multiple devices (e.g., a complex apparatus), as well as an apparatus made up of a single device (e.g., a copier, facsimile, or the like).

As described above, the present invention provides an image formation apparatus and a control method thereof, for performing accurate access to storage units provided to developing-agent-containing cartridges.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image formation apparatus comprising:

an N number of developing-agent-containing cartridges, each of which includes storage means;

cartridge holding means for rotatably holding said developing-agent-containing cartridges; and access means for accessing said storage means, wherein, in a first state, one cartridge of said number of cartridges is disposed at an image formation position by said cartridge holding means, and a latent image formed on an image carrying member is developed by said developing agent contained in said one cartridge, and wherein said access means performs accessing in a second state in which no developing-agent-containing cartridge is in the first state.

2. An image formation apparatus according to claim 1, wherein said cartridge holding means is disposable at a detaching position for detaching said developing-agent-containing cartridges, and wherein an accessing position of said access means is a position in which the developing-agent-containing cartridge detaching position is rotated by $\theta=360°\times n/N$ (n being a positive integer, $1\leqq n\leqq N$) by said cartridge holding means.

3. An image formation apparatus according to claim 1, wherein the accessing position of said access means is a position at which the image formation position is rotated by $\theta=360°\times n/N$ (n being a positive integer, $1\leqq n\leqq N-1$) by said cartridge holding means.

4. An image formation apparatus according to claim 1, wherein said storage means is a non-volatile storage means.

5. An image formation apparatus according to claim 1, comprising:

charging means for uniformly charging said image carrying member;

exposure means for performing exposure based on image information so as to form an electrostatic latent image on said image carrying member;

developing means for developing the electrostatic latent image into a toner image;

primary transfer means for transferring the toner image formed on said image carrying member onto an intermediate transfer member; and secondary transfer means for transferring the toner image formed on said intermediate transfer member onto a recording medium.

6. An image formation apparatus according to claim 5, wherein said cartridge comprises said developing means.

7. An image formation apparatus according to claim 5, wherein said cartridge comprises said image carrying member and said developing means.

8. A control method for an image formation apparatus, which comprises an N number of developing-agent-containing cartridges, each of which includes storage means and cartridge holding means for rotatably holding the developing-agent-containing cartridges, and access means for accessing the storage means, wherein a latent image formed on an image carrying member is developed by a developing agent contained in one developer-agent-containing cartridge of the number of developing-agent-containing cartridges in a first state such that the one developing-agent-containing cartridge is disposed at an image formation position by the cartridge holding means, said control method comprising:

an access step for accessing the storage means in a second state in which no developing-agent-containing cartridge is in the first state.

* * * * *